US008515314B2

(12) United States Patent
Suenami et al.

(10) Patent No.: US 8,515,314 B2
(45) Date of Patent: Aug. 20, 2013

(54) DEVELOPING DEVICE HAVING FIRST AND SECOND GROUPS OF SCRAPER BLADES IN AXIALLY OFFSET POSITIONS AND IMAGE FORMING APPARATUS WITH THE SAME

(75) Inventors: Koji Suenami, Osaka (JP); Tetsuya Toichi, Osaka (JP); Ryoji Nishimura, Osaka (JP)

(73) Assignee: Kyocera Mita Corporation (JP)

( * ) Notice: Subject to any disclaimer, the term of this patent is extended or adjusted under 35 U.S.C. 154(b) by 221 days.

(21) Appl. No.: 12/943,067

(22) Filed: Nov. 10, 2010

(65) Prior Publication Data

US 2011/0123230 A1 May 26, 2011

(30) Foreign Application Priority Data

Nov. 20, 2009 (JP) ..... 2009-265301
Nov. 24, 2009 (JP) ..... 2009-265911

(51) Int. Cl.
*G03G 15/08* (2006.01)

(52) U.S. Cl.
USPC ..... 399/254

(58) Field of Classification Search
USPC ..... 399/254, 263
See application file for complete search history.

(56) References Cited

U.S. PATENT DOCUMENTS 5,835,828 A * 11/1998 Jyoroku ..... 399/256
6,026,263 A * 2/2000 Nakahata et al. ..... 399/263
7,447,468 B2 * 11/2008 Nishimura et al. ..... 399/254
8,260,178 B2 * 9/2012 Kuroyama ..... 399/263
2008/0025763 A1 * 1/2008 Suenami ..... 399/256
2009/0136259 A1 * 5/2009 Ito ..... 399/120
2010/0196058 A1 * 8/2010 Mihara et al. ..... 399/256

FOREIGN PATENT DOCUMENTS

| | | | |
|---|---|---|---|
| JP | 6-337584 | | 12/1994 |
| JP | 2000-231251 | | 8/2000 |
| JP | 2002148916 | | 5/2002 |
| JP | 2004-333658 | | 11/2004 |
| JP | 200699043 | | 4/2006 |
| JP | 2007322800 | A * | 12/2007 |
| JP | 2008129210 | | 6/2008 |
| JP | 2008145606 | | 6/2008 |
| JP | 2009-157000 | | 7/2009 |

* cited by examiner

*Primary Examiner* — Quana M Grainger
(74) *Attorney, Agent, or Firm* — Gerald E. Hespos; Michael J. Porco; Matthew T. Hespos

(57) ABSTRACT

A developing device is provided with a developer conveyance path for conveying a developer containing nonmagnetic toner and magnetic carrier, a wall portion including a wall surface for defining the developer conveyance path, a developing roller for supplying the toner from the developer conveyance path to an image bearing member, a conveying member extending in the developer conveyance path for conveying the developer while agitating it, a toner supply port arranged above the developer conveyance path for supplying new toner into the developer conveyance path from the outside, and a scraping member arranged at a position below the toner supply port in the developer conveyance path and adapted to scrape off the toner adhering to the wall surface while sliding in contact with the wall surface of the wall portion.

8 Claims, 10 Drawing Sheets

DEVELOPING DEVICE HAVING FIRST AND SECOND GROUPS OF SCRAPER BLADES IN AXIALLY OFFSET POSITIONS AND IMAGE FORMING APPARATUS WITH THE SAME

BACKGROUND OF THE INVENTION

1. Field of the Invention

The present invention relates to a developing device using a two-component developer containing toner and carrier and an image forming apparatus provided with the same.

2. Description of the Related Art

There is known a developing device using a two-component developer containing nonmagnetic toner and magnetic carrier. This developing device generally includes a developer conveyance path for conveying the developer, a developing roller for supplying toner from the developer conveyance path to a predetermined image bearing member (e.g. photoconductive drum) to form a toner image on the image bearing member, and a screw feeder extending in the developer conveyance path for conveying the developer while agitating it. As the developer is agitated by the screw feeder, the nonmagnetic toner is charged by the magnetic carrier.

A toner supply port for supplying new toner into the developer conveyance path is provided at a position above the developer conveyance path. The toner supplied into the developer conveyance path is conveyed in the developer conveyance path by the screw feeder. When the new toner is supplied into the developer conveyance path, a specified amount of toner falls in bulk to a position below the toner supply port in the developer conveyance path. To satisfactorily charge the toner and make the toner density of the developer uniform, the toner supplied in bulk needs to be quickly dispersed into the developer.

There is known a developing device employing a technology for quickly dispersing toner. In this developing device, a shaft portion of a screw feeder includes a plurality of needle members projecting in radial directions of the shaft portion and a blade portion of the screw feeder includes a plurality of needle members projecting in an axial direction of the shaft portion. The plurality of needle members are arranged below a toner supply port. Thus, even if a specified amount of new toner is supplied in bulk, the plurality of needle members quickly disperse the toner into a developer as the screw feeder is rotated.

However, in the above developing device, the toner is likely to be accumulated in clearances between the inner surface of the developer conveyance path and the screw feeder and the plurality of needle members although the newly supplied toner is dispersed by the plurality of needle members. It is difficult to disperse the toner accumulated in the clearances into the developer by the screw feeder and the needle members. If the accumulated toner agglomerates and is conveyed into the developer conveyance path at a certain moment, it becomes difficult to satisfactorily charge the toner, wherefore so-called fogging occurs due to toner charging failure. As a result, it is difficult to form a good toner image.

SUMMARY OF THE INVENTION

An object of the present invention is to provide a developing device capable of suppressing agglomeration of newly supplied toner and an image forming apparatus provided with the same.

In order to accomplish this object, one aspect of the present invention is directed to a developing device, including a developer conveyance path for conveying a developer containing nonmagnetic toner and magnetic carrier; a wall portion including a wall surface for defining the developer conveyance path; a developing roller for supplying the toner from the developer conveyance path to an image bearing member; a conveying member extending in the developer conveyance path for conveying the developer while agitating the developer; a toner supply port arranged above the developer conveyance path for supplying new toner into the developer conveyance path from the outside; and a scraping member arranged at a position below the toner supply port in the developer conveyance path and adapted to scrape off the toner adhering to the wall surface while sliding in contact with the wall surface of the wall portion.

Another aspect of the present invention is directed to an image forming apparatus, including an image bearing member; a developing device for forming a toner image on the image bearing member by supplying toner to the image bearing member; a transfer unit for transferring the toner image to a sheet; and a fixing unit for fixing the toner image on the sheet to the sheet, wherein the developing device has the above construction.

Other objects of the present invention and advantages obtained by the present invention will become more apparent upon reading the following description of embodiments.

DETAILED DESCRIPTION OF THE PREFERRED EMBODIMENTS

Figure 1:
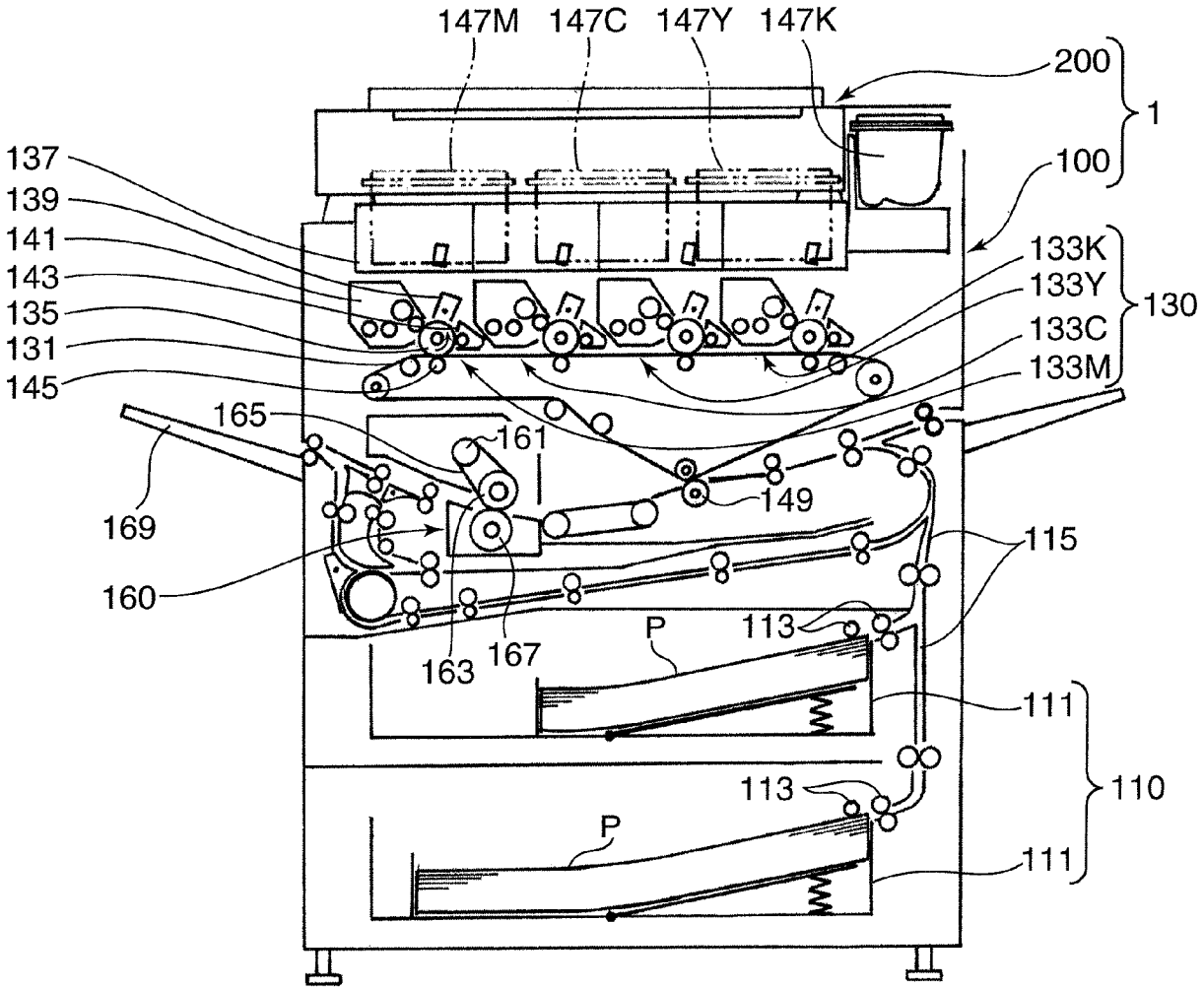
FIG. 1 is a diagram schematically showing an internal construction of an image forming apparatus according to one embodiment of the invention.

Hereinafter, embodiments of the present invention are described in detail with reference to the drawings. FIG. 1 is a diagram schematically showing an internal construction of an image forming apparatus 1 according to one embodiment of the present invention. In this embodiment, a digital complex machine having a color copy function, a color printer function and a color facsimile function is illustrated as the image forming apparatus 1. The image forming apparatus 1 includes an apparatus main body 100 and an image reader 200 arranged on the apparatus main body 100.

The image reader 200 reads an image (characters, graphics, pictures, etc.) by a CCD (Charge Coupled Device) or the like and outputs it as an image data. The image reader 200 has a function of reading a color image. Thus, color copying and color facsimile transmission are possible.

The apparatus main body 100 includes a sheet storage unit 110, an image forming station 130 and a fixing unit 160. The sheet storage unit 110 is arranged in a bottommost part of the apparatus main body 100 and includes sheet trays 111 each capable of storing a stack of sheets P. The sheet trays 111 are mounted by being inserted into the apparatus main body 100. When being replenished with sheets P, the sheet trays 111 are withdrawn from the apparatus main body 100. An uppermost sheet P in the stack of sheets P stored in the sheet tray 111 is fed toward a sheet conveyance path 115 by driving a pickup roller 113. The sheet P is conveyed to the image forming station 130 via the sheet conveyance path 115.

The image forming station 130 forms a toner image on a sheet P being conveyed. The image forming station 130 includes a magenta unit 133M, a cyan unit 133C, a yellow unit 133Y and a black unit 133K arranged in an order of transferring toner images to a transfer belt 131. These units have similar constructions and are described, taking the magenta unit 133M as an example.

The magenta unit 133M includes a photoconductive drum 135 and an exposure device 137. A charger 139, a developing device 141 and a cleaner 143 are arranged around the photoconductive drum 135. The charger 139 uniformly charges the circumferential surface of the photoconductive drum 135. The exposure device 137 generates a beam corresponding to a magenta data in an image data (image data output from the image reader 200, image data transmitted from a personal computer, facsimile-received image data, etc.) and irradiates the uniformly charged circumferential surface of the photoconductive drum 135 with this beam. In this way, an electrostatic latent image corresponding to the magenta data is formed on the circumferential surface of the photoconductive drum 135. By supplying magenta toner from the developing device 141 to the circumferential surface of the photoconductive drum 135 in this state, a toner image corresponding to the magenta data is formed on the circumferential surface of the photoconductive drum 135.

The transfer belt 131 is rotated clockwise while being sandwiched between the photoconductive drum 135 and a primary transfer roller 145. The above toner image corresponding to the magenta data is transferred from the photoconductive drum 135 to the transfer belt 131. The magenta toner remaining on the circumferential surface of the photoconductive drum 135 is removed by the cleaner 143.

Containers containing toners of corresponding colors, i.e. a magenta toner container 147M, a cyan toner container 147C, a yellow toner container 147Y and a black toner container 147K are respectively arranged above the magenta unit 133M, the cyan unit 133C, the yellow unit 133Y and the black unit 133K. The toner is supplied to the developing device 141 of each color from the corresponding container.

As described above, the toner image corresponding to the magenta data is transferred to the transfer belt 131, a toner image corresponding to a cyan data is transferred to be superimposed on this magenta toner image, and a toner image corresponding to a yellow data and a toner image corresponding to a black data are similarly transferred in a superimposition manner. In this way, a color toner image is formed on the transfer belt 131. This color toner image is transferred to a sheet P conveyed from the sheet storage unit 110 by a secondary transfer roller 149.

The sheet P having the color toner image transferred thereto is fed to the fixing unit 160. The fixing unit 160 is structured such that a fixing belt 165 is mounted on a heating roller 161 and a fixing roller 163. The fixing belt 165 is sandwiched between the fixing roller 163 and a pressure roller 167. By these rollers, the sheet P having the color toner image transferred thereto is sandwiched. In this way, heat and pressure are applied to the color toner image and the sheet P, whereby the color toner image is fixed to the sheet P. The sheet P is discharged onto a discharge tray 169.

Figure 2:
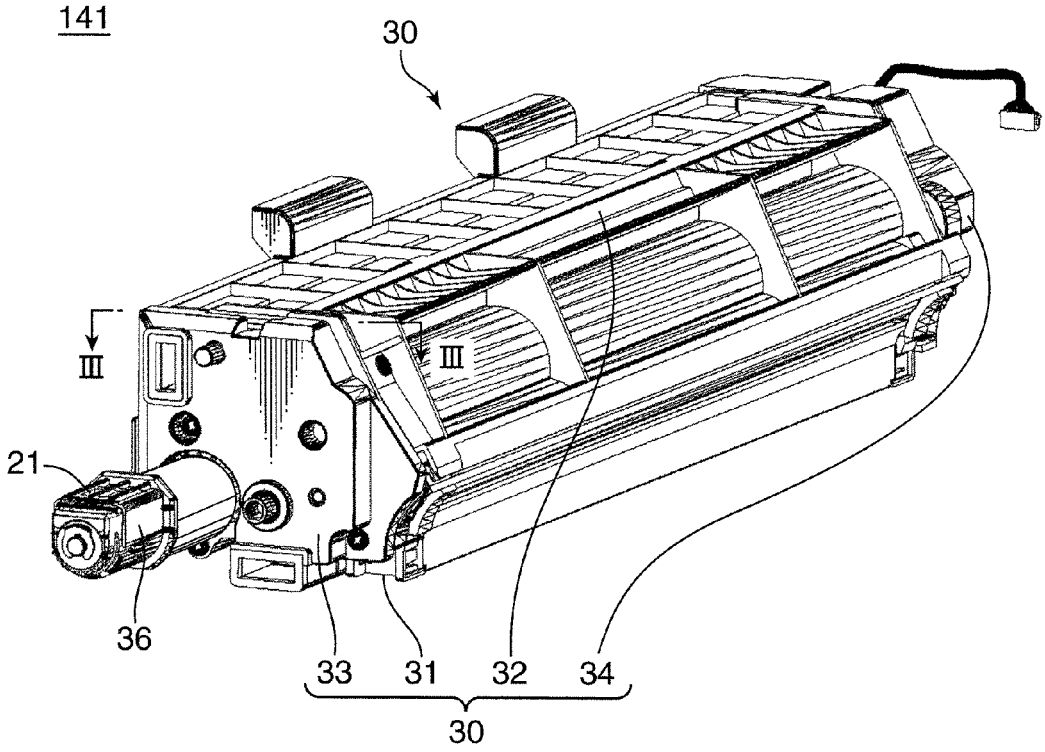
FIG. 2 is an external perspective view of a developing device provided in the image forming apparatus.
Figure 3:
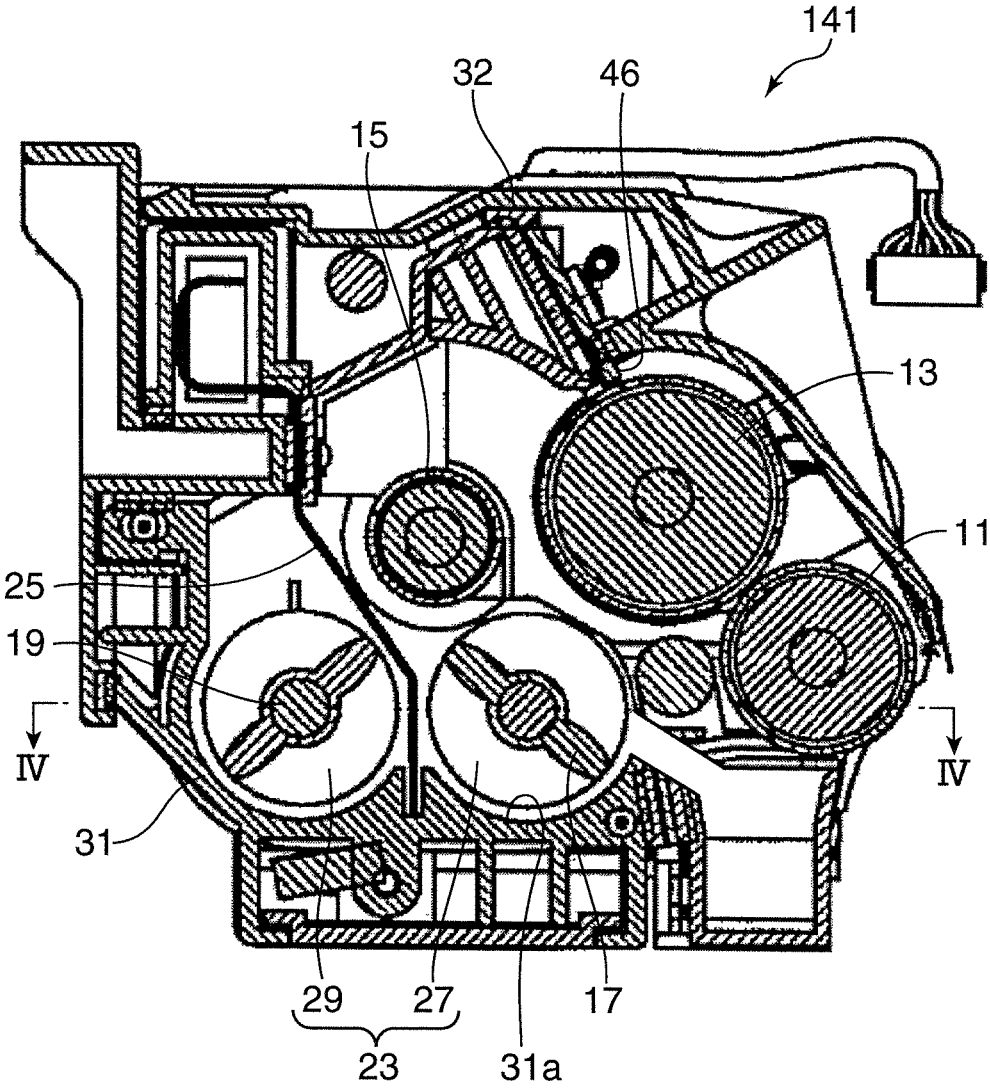
FIG. 3 is a sectional view along III-III of FIG. 2.

Next, the developing device 141 is described in detail. FIG. 2 is an external perspective view of the developing device 141. FIG. 3 is a sectional view of the developing device 141 shown in FIG. 2 cut along III-III. The developing device 141 includes a development container 30 which defines an internal space of the developing device 141 and extends in forward and backward directions of the apparatus main body 100 (directions perpendicular to the plane of FIG. 1).

The development container 30 includes a bottom container 31 extending in the forward and backward directions (i.e. longitudinal direction of the developing device 141), a main cover 32 covering the bottom container 31 from above, and a front plate 33 and a rear plate 34 closing openings at opposite longitudinal ends of the developing device 141. The internal space is defined by these bottom container 31, main cover 32, front plate 33 and rear plate 34. A toner supply portion 36 projects in the longitudinal direction of the developing device 141 from the front plate 33. The toner supply portion 36 is provided with a toner supply port 21 used to supply new toner into the developing device 141.

FIG. 3 shows an internal construction of the developing device 141. The developing device 141 includes a first developer conveyance path 27 and a second developer conveyance path 29. These conveyance paths 27, 29 are formed on an inner wall surface 31*a* facing the internal space in the bottom container 31 of the development container 30. The developing device 141 further includes a developing roller 11 arranged to face the circumferential surface of the photoconductive drum 135, a magnet roller 13 arranged to face the developing roller 11, a pumping roller 15 arranged above the first developer conveyance path 27 and near the magnet roller 13, and a developer restricting blade 46 for restricting the amount of the developer to be supplied to the magnet roller 13.

The first and second developer conveyance paths 27, 29 are paths for circulating the developer containing non-magnetic toner and magnetic carrier. The first and second developer conveyance paths 27, 29 are described in detail later.

The pumping roller 15 includes a built-in magnet, magnetically pumps up the developer from the first developer conveyance path 27 and supplies it to the circumferential surface of the magnet roller 13.

The developer restricting blade 46 is a plate-like member extending in the longitudinal direction of the developing device 141, and restricts the amount of the developer supplied from the pumping roller 15 by restricting the amount of the developer magnetically attracted to the circumferential surface of the magnet roller 13. A small clearance of a predetermined dimension is formed between a tip of the developer restricting blade 46 and the circumferential surface of the magnet roller 13. When the magnet roller 13 is rotated, the developer is restricted by the tip of the developer restricting blade 46 in the above clearance. In this way, a developer layer having a predetermined thickness is uniformly formed on the circumferential surface of the magnet roller 13.

The toner is supplied to the circumferential surface of the developing roller 11 by an electrical force in a part where the magnet roller 13 and the developing roller 11 face each other. The developing roller 11 forms a toner image on the circumferential surface of the photoconductive drum 135 by supplying the toner to the circumferential surface. Note that the developing roller 11, the magnet roller 13 and the pumping roller 15 are so arranged in the developing device 141 that axial centers thereof extend in the longitudinal direction of the developing device 141.

Figure 4:
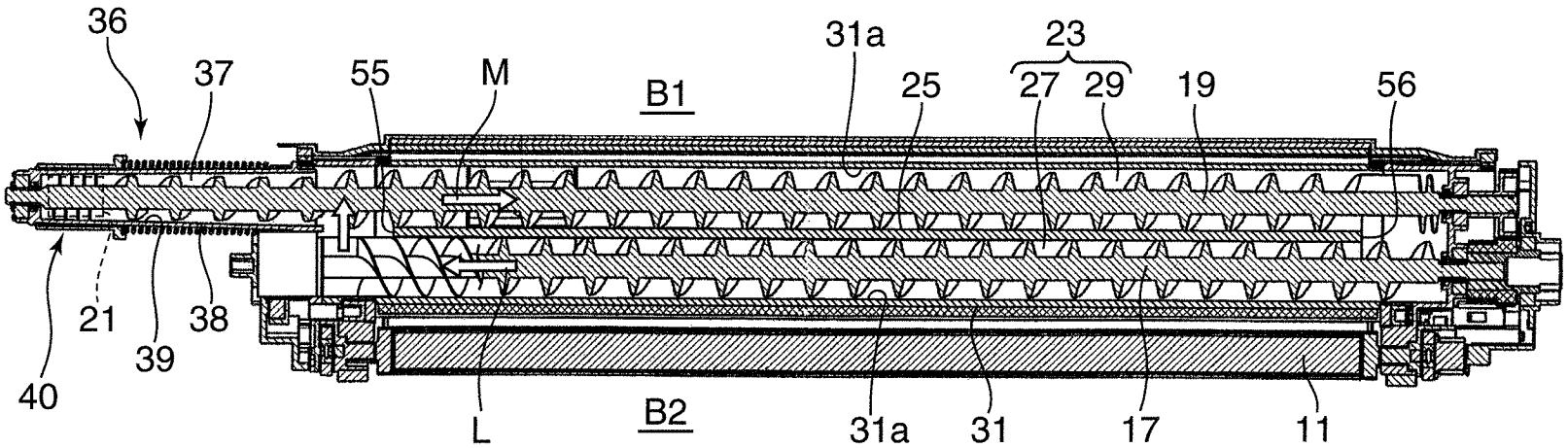
FIG. 4 is a sectional view along IV-IV of FIG. 3.

FIG. 4 is a sectional view cut along IV-IV of FIG. 3 showing the construction of the first developer conveyance path 27 (first conveyance path) and the second developer conveyance path 29 (second conveyance path) viewed from above. The inner wall surface 31*a* of the bottom container 31 of the development container 30 defines a circulation space 23 (circulating conveyance path) for circulating the developer. This circulation space 23 is partitioned by a partition wall 25 extending in the longitudinal direction of the developing device 141, thereby forming the first and second developer conveyance paths 27, 29. Both of the first and second developer conveyance paths 27, 29 extend in parallel to the longitudinal direction of the developing device 141 (lateral direction in FIG. 4).

A first screw member 17 is so arranged in the first developer conveyance path 27 as to extend in the first developer conveyance path 27. The first screw member 17 conveys the developer in a leftward direction L (first direction) in FIG. 4 while agitating the developer. A second screw member 19 is so arranged in the second developer conveyance path 29 as to extend in the second developer conveyance path 29. The second screw member 19 conveys the developer in a rightward direction M (second direction) in FIG. 4 while agitating the developer. Developer conveying directions by the first and second screw members 17, 19 are set to be opposite to each other. In this embodiment, the first and second screw members 17, 19 constitute a conveying member.

The partition wall 25 is formed with a first communication port 55 and a second communication port 56 in opposite longitudinal end parts thereof. The first and second developer conveyance paths 27, 29 communicate with each other via the first and second communication ports 55, 56, thereby forming the circulation path. The developer is circulated in a clockwise direction in the first and second developer conveyance paths 27, 29 via the first and second communication ports 55, 56 by the first and second screw members 17, 19.

As described above, the developing device 141 includes the toner supply portion 36 formed with the toner supply port 21 used to supply new toner into the developing device 141. The toner supply portion 36 is formed by a wall portion 38 projecting in the longitudinal direction from the development container 30. The toner supply portion 36 includes a toner supply path 37 defined by an inner wall surface 39 of the wall portion 38. The toner supply path 37 communicates with one end (left end in FIG. 4) of the second developer conveyance path 29, thereby constituting a part of the second developer conveyance path 29. The toner supply port 21 is located above a left end portion of the toner supply path 37. The second screw member 19 is so dimensioned that one end portion (left end portion in FIG. 4) extends in the toner supply path 37.

The toner supply portion 36 includes a scraping member 40 arranged at a position below the toner supply port 21 in the toner supply path 37. The scraping member 40 has a function of scraping off the toner from the inner wall surface 39 when the toner supplied into the toner supply path 37 via the toner supply port 21 adheres to the inner wall surface 39.

Figure 5:
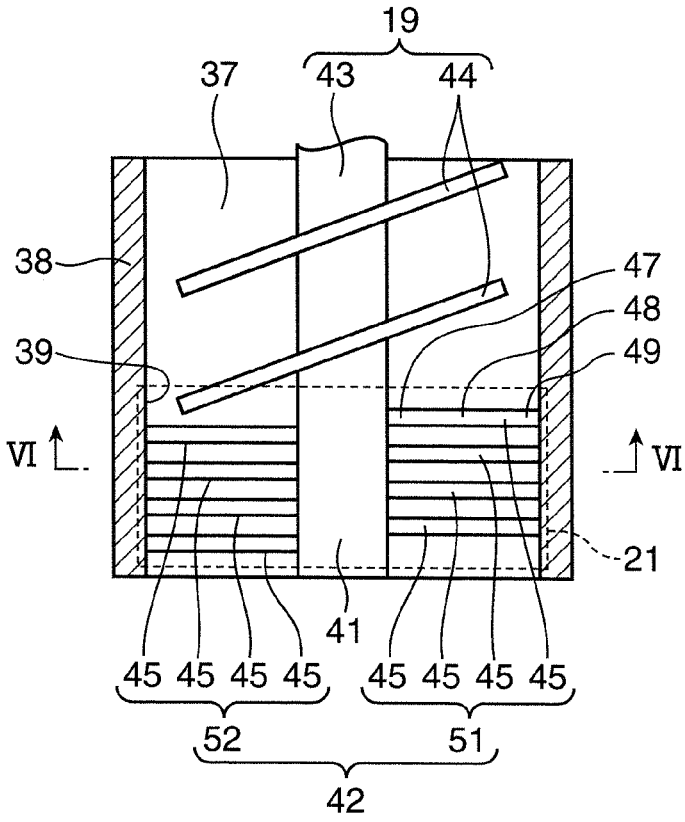
FIG. 5 is an enlarged plan view of a toner supply portion showing a scraping member according to a first embodiment.
Figure 6:
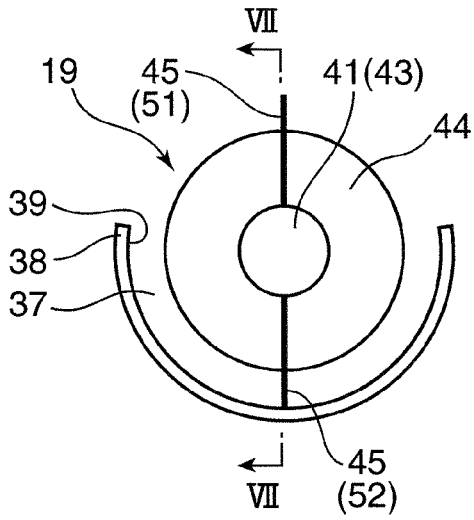
FIG. 6 is a sectional view along VI-VI of FIG. 5.
Figure 7:
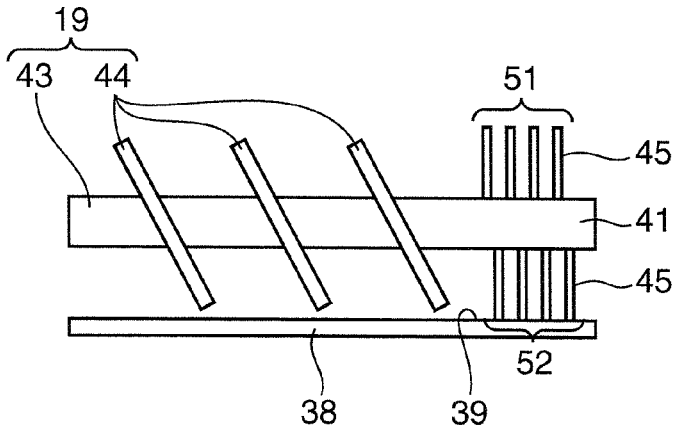
FIG. 7 is a sectional view along VII-VII of FIG. 6.

The scraping member 40 according to a first embodiment is described below with reference to FIGS. 5 to 7. FIG. 5 is an enlarged plan view of the toner supply portion 36 showing the construction of the scraping member 40. FIG. 6 is a sectional view cut along VI-VI of FIG. 5. FIG. 7 is a sectional view cut along VII-VII of FIG. 6.

The scraping member 40 includes a shaft portion 41 extending along the toner supply path 37 and rotatable about its shaft center, and a blade portion 42 provided on the outer circumferential surface of the shaft portion 41.

The second screw member 19 includes a screw shaft portion 43 extending along the second developer conveyance path 29 and the toner supply path 37 and rotatable about its shaft center, and a spiral blade portion 44 integrally provided on the outer circumferential surface of the screw shaft portion 43. In this embodiment, the shaft portion 41 of the scraping member 40 is formed by one end portion (left end portion in FIG. 4) of the screw shaft portion 43. In other words, the shaft portion 41 of the scraping member 40 and the screw shaft portion 43 of the second screw member 19 are an integral member. Note that the shaft portion 41 of the scraping member 40 and the screw shaft portion 43 of the second screw member 19 may be separate members and joined.

The blade portion 42 of the scraping member 40 is composed of a plurality of blades 45 in the form of long and thin pieces arranged in an axial direction. The respective blades 45 project in radial direction of the shaft portion 41 from the outer circumferential surface of the shaft portion 41 toward the inner wall surface 39 of the wall portion 39.

Specifically, each blade 45 is a long and thin member integrally including a base end portion 47 mounted on the outer circumferential surface of the shaft portion 41, a main portion 48 extending from the base end portion 47 toward the inner wall surface 39 and a leading end portion 49 extending from the main portion 48 toward the inner wall surface 39 and held in contact with the inner wall surface 39.

The respective blades 45 has a length extending from the outer circumferential surface of the shaft portion 41 to the inner wall surface 39, a width extending in the axial direction of the shaft portion 41 and a thickness extending in a circumferential direction of the shaft portion 41. In this embodiment, the respective blades 45 have, for example, a length of about 10.0 mm, a width of about 2.0 mm and a thickness of about 0.2 mm. The blades 45 are, for example, made of PET.

Figure 8:
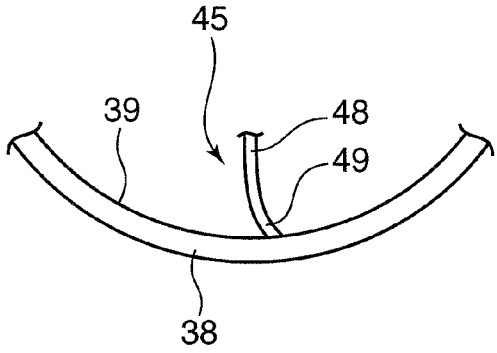
FIG. 8 is a view showing a state where blades of the scraping member are elastically deformed.

The leading end portions 49 held in contact with the inner wall surface 39 slide in contact with the inner wall surface 39, as if scratching the inner wall surface 39, as the screw shaft portion 43 of the second screw member 19, i.e. the shaft portion 41 is rotated. Particularly, when the blades 45 are made of an elastic material such as PET, they can be elastic. Accordingly, the leading end portions 49 of the blades 45 slide in contact with the inner wall surface 39 while being elastically deformed along the inner wall surface 39 in a width direction as shown in FIG. 8, wherefore a degree of adhesion between the leading end portions 49 and the inner wall surface 39 can be increased. This can improve a scraping property when the blades 45 scrape off the toner adhering to the inner wall surface 39 as described later. Note that a state of the leading end portions 49 when the shaft portion 41 is rotated clockwise is shown in FIG. 8.

In a mode shown in FIGS. 5 to 7, the blade portion 42 includes a first blade group 51 composed of a plurality of (four in FIG. 5) blades 45 arranged and spaced apart by a predetermined distance from each other in the axial direction of the shaft portion 41 and a second blade group 52 composed of a plurality of (four in FIG. 5) blades 45 similarly arranged and spaced apart by a predetermined distance from each other in the axial direction of the shaft portion 41. The first blade group 51 is arranged at a predetermined position (first position) in the circumferential direction of the shaft portion 41, and the second blade group 52 is arranged at a position (second position) spaced apart from the first blade group 51 in the circumferential direction of the shaft portion 41. Specifically, the first and second blade groups 51, 52 are spaced apart by 180° from each other with respect to the shaft portion 41.

The respective blades 45 of the second blade group 52 are arranged between the adjacent blades 45 of the first blade group 51. In other words, the blades 45 of the second blade group 52 are so arranged as not to overlap the blades 45 of the first blade group 51 when viewed in the circumferential direction of the shaft portion 41. For example, with reference to FIG. 5, the uppermost blade 45 in the second blade group 52 is set to be located between the uppermost blade 45 and the second uppermost blade 45 in the first blade group 51 when viewed in the circumferential direction of the shaft portion 41.

According to the developing device 141 described above, a specified amount of new toner is supplied while falling from the toner supply port 21 at a position below the toner supply port 21 in the toner supply path 37. At this position, the scraping member 40 is arranged. Since the leading end portions 49 of the respective blades 45 of the scraping member 40 slide in contact with the inner wall surface 39 of the wall portion 38 as the shaft portion 41 is rotated, they can scrape off the toner from the inner wall surface 39 when the newly supplied toner adheres to the inner wall surface 39. Thus, agglomeration of the toner adhering to the inner wall surface 39 is suppressed. In other words, in the developing device 141 according to this embodiment, no clearance where the supplied toner is accumulated is formed between the blade portion 42 of the scraping member 40 and the inner wall surface 39. The scraped-off toner is moved toward the second screw member 19 as the blade portion 42 is rotated.

Accordingly, so-called fogging that could occur when the agglomerated toner is conveyed into the second developer conveyance path 29 or the first developer conveyance path 27 from the toner supply path 37 at a certain moment can be suppressed. Thus, the supplied non-magnetic toner is agitated by the first and second screw members 17, 19 in the first and second developer conveyance paths 27, 29 to be satisfactorily charged by the magnetic carrier. As a result, a good toner image can be formed.

The blade portion 42 is composed of the plurality of blades 45 in the form of long and thin pieces arranged and spaced apart by the predetermined distance from each other in the axial direction of the shaft portion 41. Thus, as compared with the case where the blade portion 42 is, for example, composed of thin plate members, an air flow, which is generated when the plurality of blades 45 are rotated as the shaft portion 41 is rotated, can be suppressed. This suppresses scattering of the newly supplied toner.

Since the respective blades 45 of the second blade group 52 are arranged between the adjacent blades 45 of the first blade group 51, the blade portion 42 can scrape off the toner adhering to the inner wall surface 39 in a wide range while the shaft portion 41 makes one turn.

Further, since the blades 45 are made of PET, damage of the inner wall surface 39 is suppressed even if the blades 45 slide in contact with the inner wall surface 39, as if scratching the inner wall surface 39. Furthermore, since the blades 45 can be elastic by making the blades 45 of PET, the blades 45 slide in contact with the inner wall surface 39 while being elastically deformed. This can improve a toner scraping property by the blades 45.

Further, since the scraping member 40 can be made of common members, i.e. the shaft portion 41 and the blade portion 42 provided on the shaft portion 41, the complication of the construction of the developing device 141 can be avoided while fogging is suppressed.

Although the second blade group 52 is spaced apart by 180° from the first blade group 51 with respect to the shaft portion 41 in the above embodiment, a spacing angle of the second blade group 52 from the first blade group 51 is not particularly limited as long as the toner adhering to the inner wall surface 39 is reliably scraped off.

Although the two blade groups 51, 52 are provided in the above embodiment, the number of the blade groups is not limited to two and may be three or more. For example, if there are first to third blade groups, the first to third blade groups are spaced apart by 120° from each other. Further, if there are first to fourth blade groups, the first to fourth blade groups are spaced apart by 90° from each other.

Figure 9:
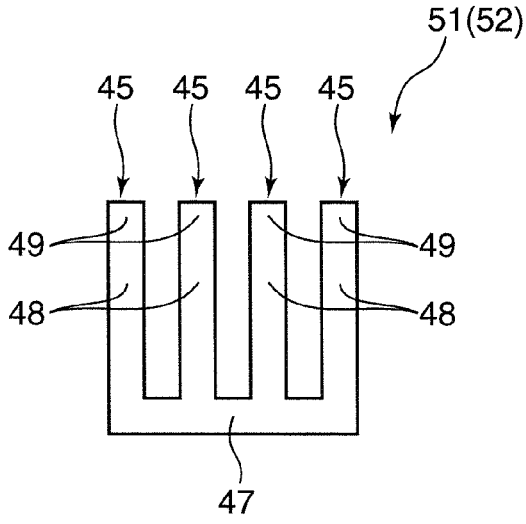
FIG. 9 is a view showing a modification of a blade portion of the scraping member.

In the first and second blade groups 51, 52, the base end portions 47 of the respective blades may be connected and united as shown in FIG. 9. The main portions 48 and the leading end portions 49 extend from the common base end portion 47. The first and second blade groups 51, 52 according to this modification can be more easily mounted on the outer circumferential surface of the shaft portion 41.

Next, an experiment conducted using the developing device 141 according to this embodiment is described. In this experiment, a toner density in the first developer conveyance path 27 when 200 sheets were consecutively printed with a coverage rate of 5% while a toner supply speed was maintained constant was measured using a toner density sensor disposed in the first developer conveyance path 27. An experimental result for the developing device 141 employing the scraping member 40 is shown in FIG. 10 and that for a developing device 141 employing no scraping member 40 is shown in FIG. 11.

Figure 10:
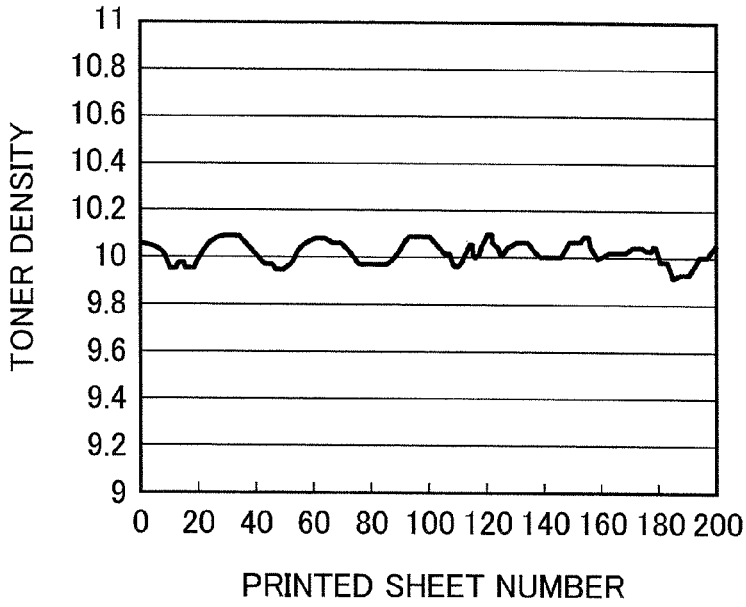
FIG. 10 is a graph showing a toner density variation in the developing device of this embodiment employing the scraping member.

In the developing device 141 employing the scraping member 40, the toner density was stable over the entire period of printing 200 sheets as is clear from FIG. 10. This result indicates that the supplied toner was not agglomerated due to the presence of the scraping member 40.

Figure 11:
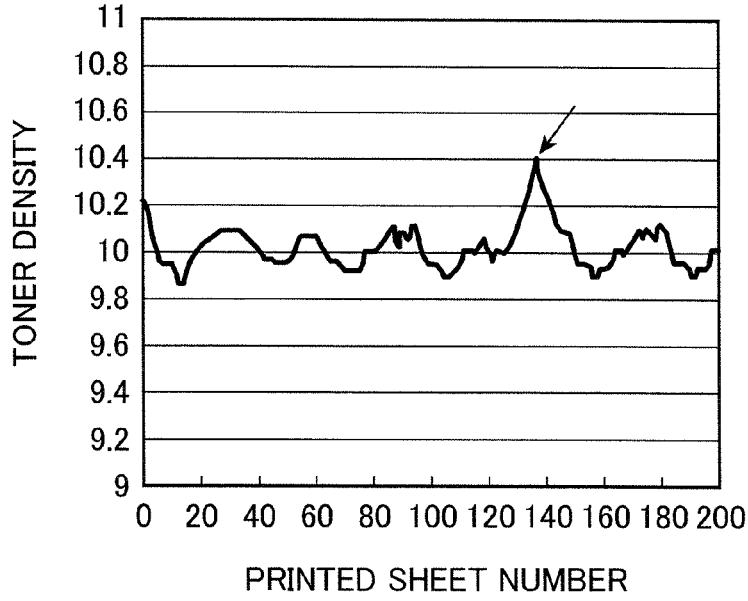
FIG. 11 is a graph showing a toner density variation in a developing device as a comparative example employing no scraping member.

On the other hand, in the developing device 141 employing no scraping member 40, the toner density drastically increased when about the $140^{th}$ sheet was printed as shown in FIG. 11. This result indicates that the supplied toner is agglomerated and conveyed into the first developer conveyance path 27 to cause fogging. As is clear from FIG. 11, it was confirmed that a toner density variation was larger in the developing device 141 employing no scraping member 40 than in the developing device 141 employing the scraping member 40.

From the above experimental results, it was confirmed that the scraping member 40 was effective in suppressing fogging.

Next, a scraping member 40A according to a second embodiment is described with reference to FIGS. 12 to 17. The scraping member 40A is arranged in the toner supply path 37 (see FIG. 4) similar to the scraping member 40 of the first embodiment described above, and has a function of scraping off the toner from the inner wall surface 39 when the toner adheres to the inner wall surface 39 of the toner supply path 37. The scraping member 40A includes a rotary shaft 251 (shaft portion) and agitating blades 255 (blade portion) projecting in radial directions of the rotary shaft 251.

The rotary shaft 251 can be integrally mounted on one end portion of the screw shaft portion 43 (see FIG. 5) of the second screw member 19 similar to the first embodiment. Alternatively, it is also possible to provide a shaft portion for rotatably supporting the rotary shaft 251 in the toner supply path 37 separately from the screw shaft portion 43 and make the rotary shaft 251 rotatable in forward and reverse directions. In the following description is described a mode in which the rotary shaft 251 is rotated in forward and reverse directions.

The rotary shaft 251 is a cylindrical member, and a base portion 251*a* including bonding portions 251*b* having substantially rectangular planes is formed by cutting the outer circumferential surface of the rotary shaft 251 in a substantially axial middle part. Two bonding portions 251*b* (first and second bonding portions) are formed substantially in parallel to each other at positions at the opposite sides of and equidistant from a rotary shaft center X. In other words, the bonding portions 251*b* are point-symmetrically arranged with respect to the shaft center X. The agitating blades 255 (first and second agitating blades) are respectively bonded to the respective bonding portions 251*b*.

The agitating blades 255 are made of a flexible material such as a PET film or an other resin sheet and include first surfaces to be bonded to the respective bonding portions 251*b* of the base portion 251*a* by an adhesive 257 (see FIG. 17) and second surfaces opposite to the first surfaces. By bonding one end portion of the first surface to the bonding portion 251*b*, the agitating blade 255 is fixed to the rotary shaft 251. The two agitating blades 255 project from the bonding portions 251*b* toward the opposite sides in directions (lateral directions of FIG. 12) orthogonal to an axial direction.

The respective agitating blades 255 project outward from upstream ends of the respective bonding portions 251*b* in a forward rotating direction (counterclockwise direction of FIG. 12) of the rotary shaft 251. In other words, the upper agitating blade 255 (first blade portion) in FIG. 12 projects rightward from a right end portion of the upper bonding portion 251*b* (first bonding portion), and the lower agitating blade 255 (second blade portion) projects leftward from a left end portion of the lower bonding portion 251*b*. Thus, when the agitating blades 255 agitate and scrape the toner during the forward rotation of the scraping member 40A, reaction forces (see white arrows in FIG. 12) received from the toner and the inner wall surface 39 act in a direction to press the agitating blades 255 toward the bonding portions 251*b*. This can prevent the agitating blades 255 from being peeled off from the bonding portions 251*b* during the forward rotation of the rotary shaft 251.

Figure 12:
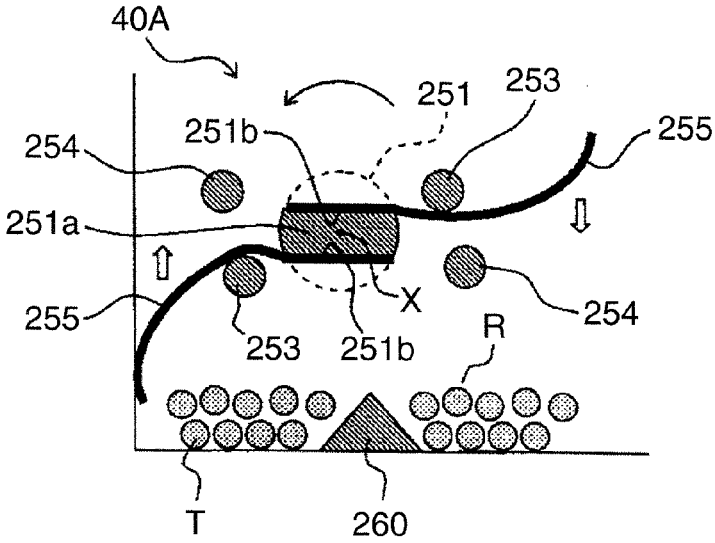
FIG. 12 is a sectional view showing a scraping member according to a second embodiment.
Figure 13:
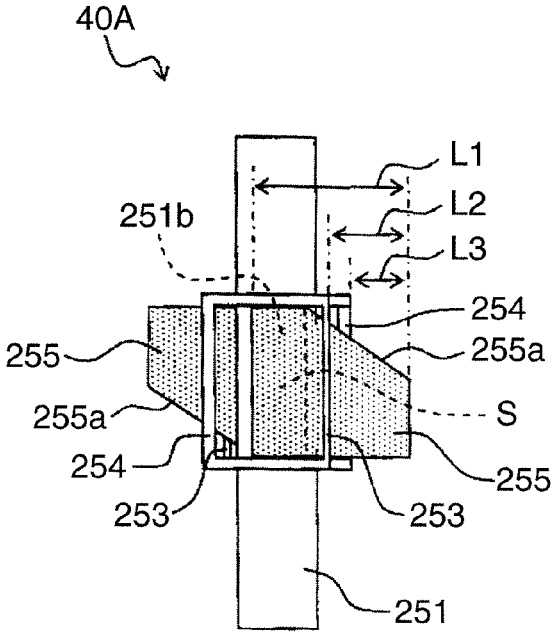
FIG. 13 is a plan view of the scraping member of FIG. 12.

As shown in FIG. 13, a projecting portion of each agitating blade 255 projecting from the bonding portion 251*b* has a substantially rectangular shape and one end side thereof is formed into an inclined portion 255*a* inclined toward the other end side in the axial direction (vertical direction in FIG. 13). By forming such inclined portions 255*a*, air can be entrained to prevent a reduction in agitation efficiency when the toner is agitated by the agitating blades 255. Further, the projecting portions of the agitating blades 255 are curved toward downstream sides when the rotary shaft 251 is rotated in the forward direction (see FIG. 12), thereby being able to easily agitate the toner during the forward rotation of the rotary shaft 251.

Here is assumed a case where a projection 260 projecting upward is formed at a bottom part of the inner wall surface 39 as shown in FIG. 12. In such a case, even if the rotary shaft 251 is rotated in the forward direction, toner T present on the left side of the projection 260 can be scraped by the scarping member 40A, but the right side of the projection 260 becomes a dead space R. Thus, the toner T present in the dead space R is accumulated without being scraped by the scarping member 40A.

The rotary shaft 251 needs to be rotated in a clockwise direction of FIG. 12 (reverse rotation) to scrape the toner T accumulated in the dead space R. However, if the rotary shaft 251 is rotated in the reverse direction, reaction forces received from the toner and the like when the agitating blades 255 agitate and scrape the toner act in a direction to peel the agitating blades 255 from the bonding portions 251*b* (direction opposite to the one indicated by the white arrows in FIG. 12) differently from those during the forward rotation, wherefore the agitating blades 255 are more likely to be peeled.

Figure 14:
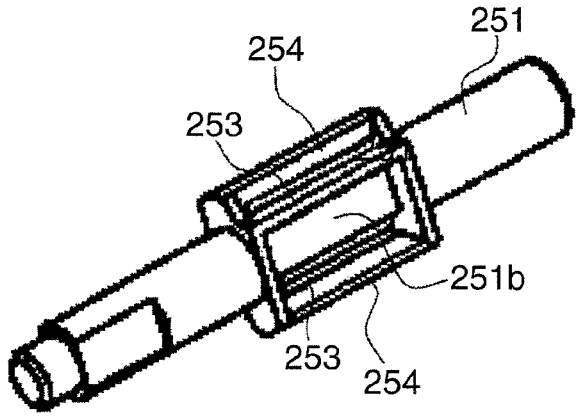
FIG. 14 is a perspective view showing a rotary shaft of the scraping member according to the second embodiment.
Figure 15A:
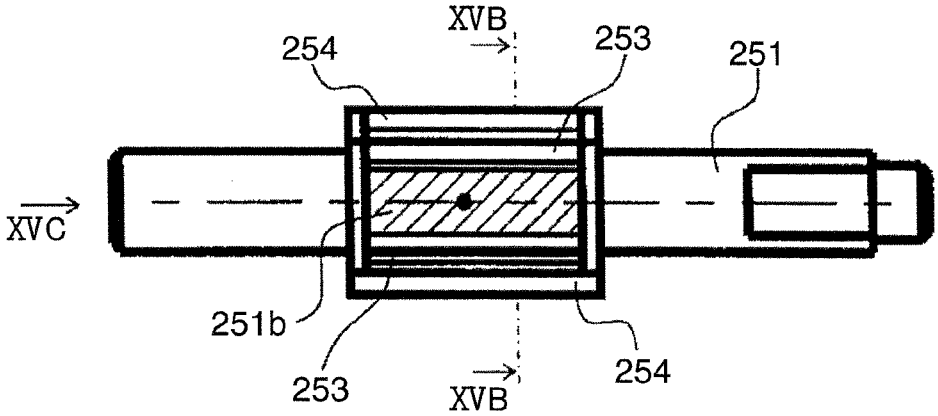
FIG. 15A is a plan view of the rotary shaft.
Figure 15B:
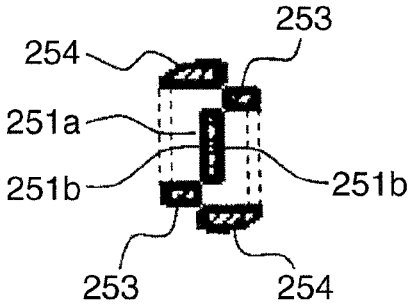
FIG. 15B is a sectional view along XVB-XVB.
Figure 15C:
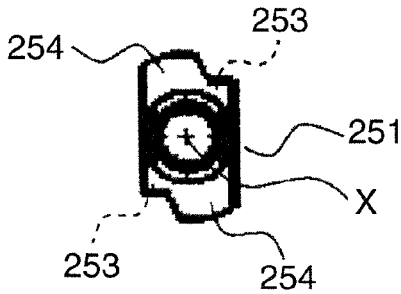
FIG. 15C is a view seen in a direction XVC.
Figure 16:
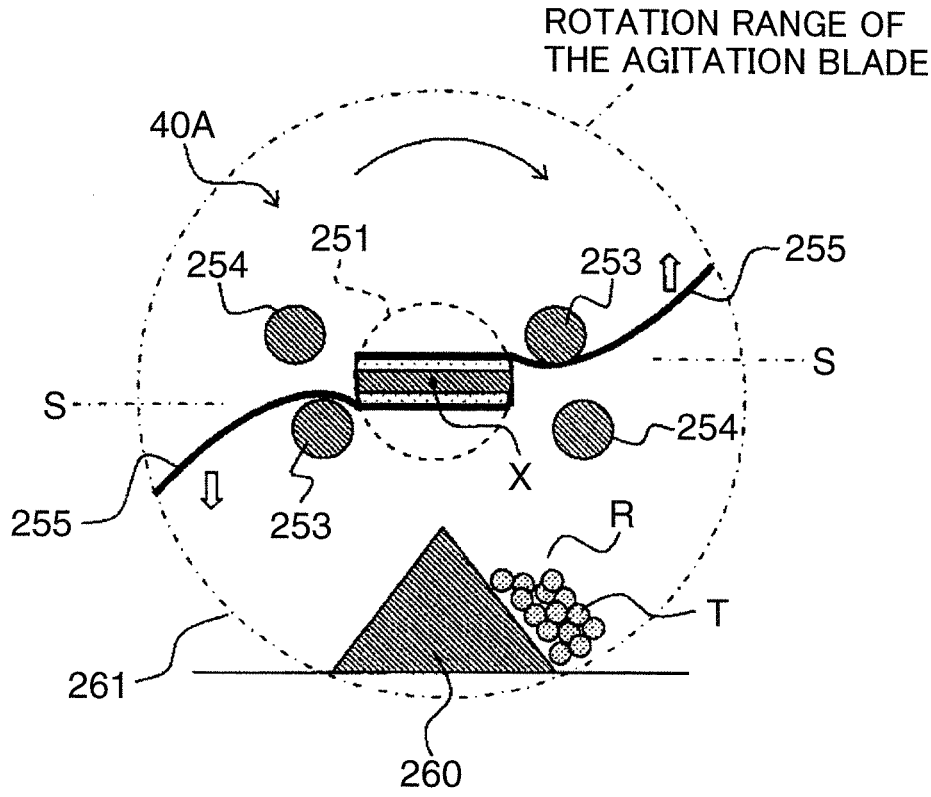
FIG. 16 is a view diagrammatically showing a state where the rotary shaft is rotated in a reverse direction.

Accordingly, in this embodiment, the rotary shaft 251 includes two supporting portions 253 for supporting the agitation blades 255. FIG. 14 is a perspective view of the rotary shaft 251. FIG. 15A is a plan view of the rotary shaft 251. FIG. 15B is a sectional view along XVB-XVB of FIG. 15A. FIG. 15C is a view seen in a direction XVC of FIG. 15A.

The supporting portions 253 are respectively formed in a pair of frame portions 254 projecting from the rotary shaft 251. The frame portions 254 are for supporting the supporting portions 253 to fixedly arrange the supporting portions 253 at predetermined positions with respect to the rotary shaft 251, and formed integrally to the rotary shaft 251.

The respective frame portions 254 project from the outer circumferential surface of the rotary shaft 251 in directions perpendicular to the respective bonding portions 251*b* in such a manner as to cover the outer surfaces of the bonding portions 251*b*. Each frame portion 254 is formed to have a U-shape with an opening at a side toward which the corresponding agitation blade 255 bonded to the bonding portion 251*b* projects (see FIG. 13).

Each supporting portion 253 is a bar-like member connecting both ends of the U-shaped frame portion 254 at the open side and formed integrally to the frame portion 254. In other words, the supporting portion 253 and the frame portion 254 are formed to have a rectangular frame shape when viewed in a direction perpendicular to the bonding portion 251*b* (direction perpendicular to the plane of FIG. 15A). The supporting portions 253 are arranged in parallel to the axial direction of the rotary shaft 251. Further, as is also clear from FIGS. 12 and 15B, the supporting portions 253 are arranged at more outer sides than the bonding portions 251*b* with respect to the rotary shaft center X in directions orthogonal to an extending direction of the rotary shaft center X of the rotary shaft 251.

Figure 17:
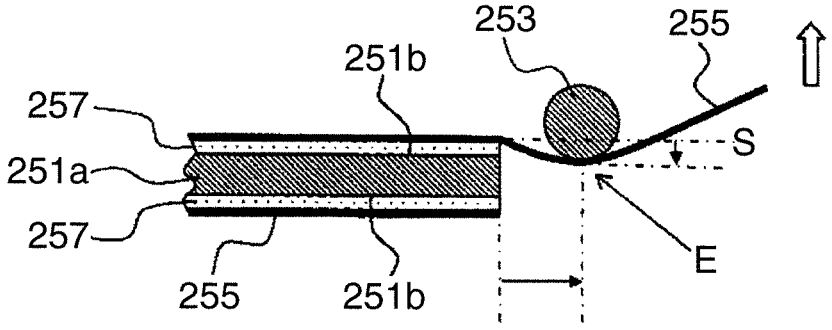
FIG. 17 is a partial enlarged view diagrammatically showing an arrangement relationship of a supporting portion and a blade portion in the scraping member of FIG. 16.

In addition, the supporting portions 253 are arranged to be closer to the base portion 251*a* than extension planes of the first bonding surfaces S of the agitation blades 255. In other words, as shown in FIG. 17, if a horizontal extension plane of the bonding surface S with the first surface of the agitation blade 255 bonded to the adhesive 257 is assumed to be a boundary plane between a first area away from the base portion 251*a* and a second area inwardly toward the base portion 251*a*, a part of the supporting portion 253 is located in the second area. This part of the supporting portion 253 is in contact with the second surface (non-bonding surface) of the agitation blade 255 in the second area to support the agitation blade 255. Note that the supporting portions 253 are respectively arranged to be point symmetrical with respect to the shaft center X of the rotary shaft 251 and the frame portions 254 are formed to be point symmetrical with respect to the shaft center X.

An exemplary set of dimensions is given here. If L1 denotes a length of the agitation blade 255 in the direction (lateral direction of FIG. 13) perpendicular to the axial direction, L2 denotes a projecting length thereof from the supporting portion 253 and L3 denotes a projecting length thereof from the frame portion 254 adjacent to the supporting portion 253 with the agitation blade 255 therebetween, L1, L2 and L3 can be, for example, 12 mm, 6.5 mm and 5 mm, respectively.

Further, a length of the bonding portion 251*b* in the direction perpendicular to the axial direction can be, for example, 4 mm and a length thereof in the axial direction (vertical direction of FIG. 13) can be, for example, 10 mm. In conformity with this, a length of the bonding surface of the agitation blade 255 to be bonded to the bonding portion 251*b* in the direction perpendicular to the axial direction can be, for example, 4 mm and a length thereof in the axial direction can be about 10 mm.

Next, a reverse rotation operation of the scraping member 40A is described. When the rotary shaft 251 is rotated clockwise (reverse rotation) in FIG. 16 contrary to FIG. 12, the toner T present in the dead space R formed at the right side of the projection 260 can be scraped toward the left side of the projection 260. During this reverse rotation, the agitation blades 255 receive reaction forces from the toner and the like acting in a direction opposite to a direction of the reverse rotation (see white arrows in FIGS. 16 and 17) when agitating and scraping the toner T.

However, since the supporting portion 253 comes into contact with the agitation blade 255 from an upstream side (upper side in FIG. 17) in the direction of the reverse rotation, the agitation blade 255 can be prevented from being pulled in a direction to be peeled off from the bonding portion 251*b* on the bonding surface S even if being subjected to the above reaction force. In addition, since the supporting portion 253 can support the agitation blade 255 at a side closer to the base portion 251*a* (lower side in FIG. 17) than the bonding surface S, the agitation blade 255 is pulled with the supporting portion 253 as a supporting point E when the above reaction force acts on the agitation blade 255. Therefore, a force of such a direction as to press the agitation blade 255 toward the bonding portion 251*b* (toward the lower side of FIG. 17) acts on the bonding surface S.

As described above, according to the scraping member 40A of the second embodiment, even if an obstacle such as the projection 260 is present in the toner supply path 37, the toner T present in the dead space R can be satisfactorily scraped by repeating the reverse rotation and the forward rotation of the rotary shaft 251. Further, the agitation blades 255 can be prevented from being peeled off from the bonding portions 251*b* during both the forward rotation and the reverse rotation.

This application is based on Japanese Patent application serial Nos. 2009-265301 and 2009-265911 filed in Japan Patent Office on Nov. 20, 2009 and Nov. 24, 2010 the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device, comprising:

a developer conveyance path for conveying a developer containing nonmagnetic toner and magnetic carrier;

a wall portion including a wall surface for defining the developer conveyance path;

a developing roller for supplying the toner from the developer conveyance path to an image bearing member;

a conveying member extending in the developer conveyance path for conveying the developer while agitating the developer;

a toner supply port arranged above the developer conveyance path for supplying new toner into the developer conveyance path from the outside; and a scraping member arranged at a position below the toner supply port in the developer conveyance path and adapted to scrape off the toner adhering to the wall surface while sliding in contact with the wall surface of the wall portion, the scraping member including:

a shaft portion extending along the developer conveyance path and rotatable about a shaft center thereof, and a blade portion provided on the shaft portion and projecting from a circumferential surface of the shaft portion toward the wall portion; and the blade portion being made of an elastic material and including:

a first blade group arranged at a first position of the shaft portion and composed of a plurality of blades in the form of long, thin pieces spaced apart by a predetermined distance from each other in an axial direction of the shaft portion; and a second blade group arranged at a second position of the shaft portion spaced from the first position in a circumferential direction and composed of a plurality of blades in the form of long, thin pieces spaced apart by a predetermined distance from each other in the axial direction of the shaft portion; and the respective blades of the second blade group being arranged at positions aligned with positions between adjacent blades of the first blade group in the axial direction; and the blades of the first blade group and the second blade group scrape off the toner adhering to the wall portion while sliding in contact with the wall portion as the shaft portion is rotated.

2. A developing device according to claim 1, wherein:

the conveying member includes:

a screw shaft portion extending along the developer conveyance path and rotatable about a shaft center thereof, and a screw member having a spiral blade portion provided on the outer circumferential surface of the screw shaft portion; and one end portion of the screw shaft portion is used as the shaft portion of the scraping member.

3. A developing device according to claim 1, wherein:

the blade portion includes a first surface and a second surface opposite to the first surface; and the shaft portion includes:

a base portion having a bonding portion, to which the first surface of the blade portion is to be bonded, and a supporting portion arranged at a more outer side than the bonding portion with respect to a rotary shaft center of the shaft portion in a direction orthogonal to an extending direction of the rotary shaft center.

4. A developing device according to claim 3, wherein:

the bonding portion is a flat surface formed on a surface of the base portion; and the supporting portion comes into contact with the second surface in a second area if a horizontal extension plane of the first surface bonded to the flat surface is assumed to be a boundary plane between a first area away from the base portion and the second area inwardly toward the base portion.

5. A developing device according to claim 3, wherein:

the bonding portion includes a first bonding portion and a second bonding portion formed substantially in parallel with the rotary shaft center therebetween;

the blade portion includes a first blade portion and a second blade portion to be respectively bonded to the first and second bonding portions; and the first and second blade portions respectively project toward opposite sides from the first and second bonding portions in the orthogonal direction.

6. A developing device according to claim 1, wherein:

the developer conveyance path includes:

a circulating conveyance path for circulating the developer, and a toner supply path for supplying the toner to the circulating conveyance path; and the toner supply port is arranged above the toner supply path.

7. A developing device according to claim 6, wherein:

the circulating conveyance path includes:

a first conveyance path for conveying the developer in a first direction, a second conveyance path arranged in parallel to the first conveyance path and adapted to convey the developer in a second direction opposite to the first direction, a first communication port for permitting the first and second conveyance paths to communicate at one end side, and a second communication port for permitting the first and second conveyance paths to communicate at the other end side; and the toner supply path communicates with the one end side of the second conveyance path to convey the developer in the second direction.

8. An image forming apparatus, comprising:

an image bearing member;

a developing device for forming a toner image on the image bearing member by supplying toner to the image bearing member;

a transfer unit for transferring the toner image to a sheet; and a fixing unit for fixing the toner image on the sheet to the sheet, wherein the developing device includes:

a developer conveyance path for conveying a developer containing nonmagnetic toner and magnetic carrier;

a wall portion including a wall surface for defining the developer conveyance path;

a developing roller for supplying the toner from the developer conveyance path to the image bearing member;

a conveying member extending in the developer conveyance path for conveying the developer while agitating the developer;

a toner supply port arranged above the developer conveyance path for supplying new toner into the developer conveyance path from the outside; and a scraping member arranged at a position below the toner supply port in the developer conveyance path and adapted to scrape off the toner adhering to the wall surface while sliding in contact with the wall surface of the wall portion, the scraping member including:

a shaft portion extending along the developer conveyance path and rotatable about a shaft center thereof, and a blade portion provided on the shaft portion and projecting from a circumferential surface of the shaft portion toward the wall portion; and the blade portion being made of an elastic material and including:

a first blade group arranged at a first position of the shaft portion and composed of a plurality of blades in the form of long, thin pieces spaced apart by a predetermined distance from each other in an axial direction of the shaft portion; and a second blade group arranged at a second position of the shaft portion spaced from the first position in the circumferential direction and composed of a plurality of blades in the form of long, thin pieces spaced apart by a predetermined distance from each other in the axial direction of the shaft portion; and the respective blades of the second blade group are arranged at positions aligned with positions between adjacent blades of the first blade group in the axial direction; and the blades of the first blade group and the second blade group scrape off the toner adhering to the wall portion while sliding in contact with the wall portion as the shaft portion is rotated.

* * * * *